US005334249A

United States Patent [19]

Osbon

[11] Patent Number: 5,334,249

[45] Date of Patent: Aug. 2, 1994

[54] PROGRAMMABLE ELECTRICALLY CONTROLLED PHOTOEYE LINKED APPLICATOR FOR GLUE GUNS

[75] Inventor: Edward E. Osbon, West Monroe, La.

[73] Assignee: Greg D. Thompson, West Monroe, La.

[21] Appl. No.: 10,189

[22] Filed: Jan. 28, 1993

[51] Int. Cl.[5] ..... B05C 11/00

[52] U.S. Cl. ..... 118/679; 118/696; 118/700; 118/701

[58] Field of Search ..... 118/314, 323, 324, 679, 118/680, 681, 684, 696, 700, 701

[56] References Cited

U.S. PATENT DOCUMENTS

| | | | |
|---|---|---|---|
| 4,157,058 | 6/1979 | Vogel | 93/36.3 |
| 4,421,800 | 12/1983 | Schoenberg et al. | 118/677 |
| 4,553,954 | 11/1985 | Sewell et al. | 493/309 |
| 4,995,697 | 2/1991 | Adamovsky | 350/96.29 |
| 5,061,519 | 10/1991 | Long | 427/207.1 |

*Primary Examiner*—W. Gary Jones
*Assistant Examiner*—Dean T. Nguyen
*Attorney, Agent, or Firm*—Laurence R. Brown

[57] ABSTRACT

An easy to use and inexpensive programmable electronic control system is provided for control of glue guns to spot glue on controllable positions on a carton blank, being conveyed past a glue station. The controls are synchronously related to the position of a workpiece on a conveyor platform by means of a rotary shaft in the conveyor mechanism to which a rotating timing wheel is coupled for precisely and synchronously identifying positions along the length of the workpiece. One or more solenoid actuated glue guns, may be positioned in preselected lanes across the width of the workpiece. By means of markers rotated by the timing wheel and an optical sensor coupled to a position adjacent the moving marker controls the glue dispensers. By means of a small diameter fiber link between the optical sensor and the marker, precise timing and control of glue dot positions is achieved for high fidelity and high speed response. A simple electronic switching circuit permits control of one or more work heads for reaching any two dimensional position on the workpiece. A keyboard programming array of twenty positions, for example, permits selection of sixteen different glue stripes in four different lanes on the work piece.

8 Claims, 3 Drawing Sheets

44
45
43
50
42
40
41
78
54
53
52
11
51
55
60
69
65
68
64
67
63
66
62
73
77
72
76
75
71
70
74
61
1
2
3
4
47

PROGRAMMABLE ELECTRICALLY CONTROLLED PHOTOEYE LINKED APPLICATOR FOR GLUE GUNS

TECHNICAL FIELD

This invention relates to a system for controlling the disposition of glue upon workpieces such as carton blanks, and more particularly it relates to electronic switching systems for programming the location of glue line and dot positions on workpieces carried by a conveyor mechanism past a glue station.

BACKGROUND

Systems for timing glue guns in response to movement of workpieces such as carton blanks are known in the art. For example, U.S. Pat. No. 4,553,954, Sewell, et. al., for Automatic Case Erector and Sealer, Nov. 19, 1985 provides for control of a glue nozzle by means of electrical switches positioned to sense the carton as it is moved by the switch. Not only are electrical sensing switches critical in positioning and unreliable in operation because they mechanically break electrical current paths, but they are very limited in the ability to program a gluing system universally for any desired pattern of glue on a workpiece. Particularly when in an environment that has lint and dust from cartons in the vicinity, such switches can become contaminated. They are not always positionable where desired for control because of limitations of machine geometry. Thus, a more reliable and more universally programmable system is an objective of the present invention.

Glue rollers are also used to roll on glue as shown in U.S. Pat. No. 4,157,058, Vogel, for Long Seam Gluer, Jun. 5, 1979. These rollers give little flexibility of placement and programming for different seam lengths or cartons.

Computer controlled programmable gluing systems are very expensive, and require considerable expertise for set up and change from one gluing pattern to another. Thus, they cannot generally be operated by routine unexperienced labor usually hired for gluing cartons and the like in manufacturing plants. Even so, the programming procedure is long and tedious and can readily result in programming errors.

It is therefore an object of this invention to provide an inexpensive and simple to operate programmable general purpose gluing pattern control system that improves the state of the art.

DISCLOSURE OF THE INVENTION

A simple and easily understood variably programmable system for dispensing glue in predetermined patterns on workpieces being conveyed past a gluing station by a conveyor mechanism is provided by this invention. Thus, a custom setup for a complex gluing pattern produced in one embodiment by four different glue heads in a multi-station gluing unit is controlled by a twenty switch manual keyboard. A pattern of dots or lines of different lengths at any positions on a workpiece sheet is achievable to produce as many as sixteen different glue patterns in different corresponding workpiece locations. All of this is done by means of electronic logic circuits in a precise manner fully compatible with operation of high speed transport conveyors.

Synchronous timing of the glue positions with the workpieces is achieved by coupling a timing wheel to a rotary shaft on the workpiece conveyor, preferably for a single revolution per workpiece cycle. Then detectable markers of appropriate dimensions to specify glue dots or line lengths are variably positioned relative to predetermined sectors to rotate with the wheel and thereby identify a set of programmed glue line lengths along moving workpieces. With four laterally positionable solenoid operated glue heads positionable across a worksheet glue lines can be deposited at various lateral positions on the workpiece, thereby affording two-dimensional control of gluing patterns. Thus typically, each marker line may be separately controlled in four different patterns by lateral positioning of four markers on a rotary marker wheel, drum or series of discs, to give a total of sixteen control positions in an embodiment that has twenty program control keys. Thus a universal set of glue patterns is available with custom set up for a specified two dimensional glue pattern taking as little as ten minutes. Precise control of glue nozzle timing afforded by electronic sensing and nozzle control circuitry will permit dispensing in dot patterns at precise locations on the workpiece.

The markers are preferably reflective to be sensed by optical sensors. For precise positioning and instantaneous response, a small diameter optical fiber is coupled as a link between the optical sensor and a detection station adjacent the path of the markers. The simple electronic logic for control of the solenoid actuated glue guns is preferably achieved by solid state electronic modules that drive solid state relays. This system provides rapid response and long life. The system may be retrofit on any gluing machine that cyclically passes worksheets on a conveyor past a gluing station, provided there is access to a rotary conveyor drive member for coupling the timing wheel and a position is available across the worksheet to laterally mount the heads along a suitable positioning rack.

Other objects, features and advantages of the invention will be found throughout the following description, drawings and claims.

BRIEF DESCRIPTION OF THE DRAWINGS

In the accompanying drawings wherein like reference characters refer to similar features to facilitate comparison.

THE PREFERRED EMBODIMENTS

Figure 1:
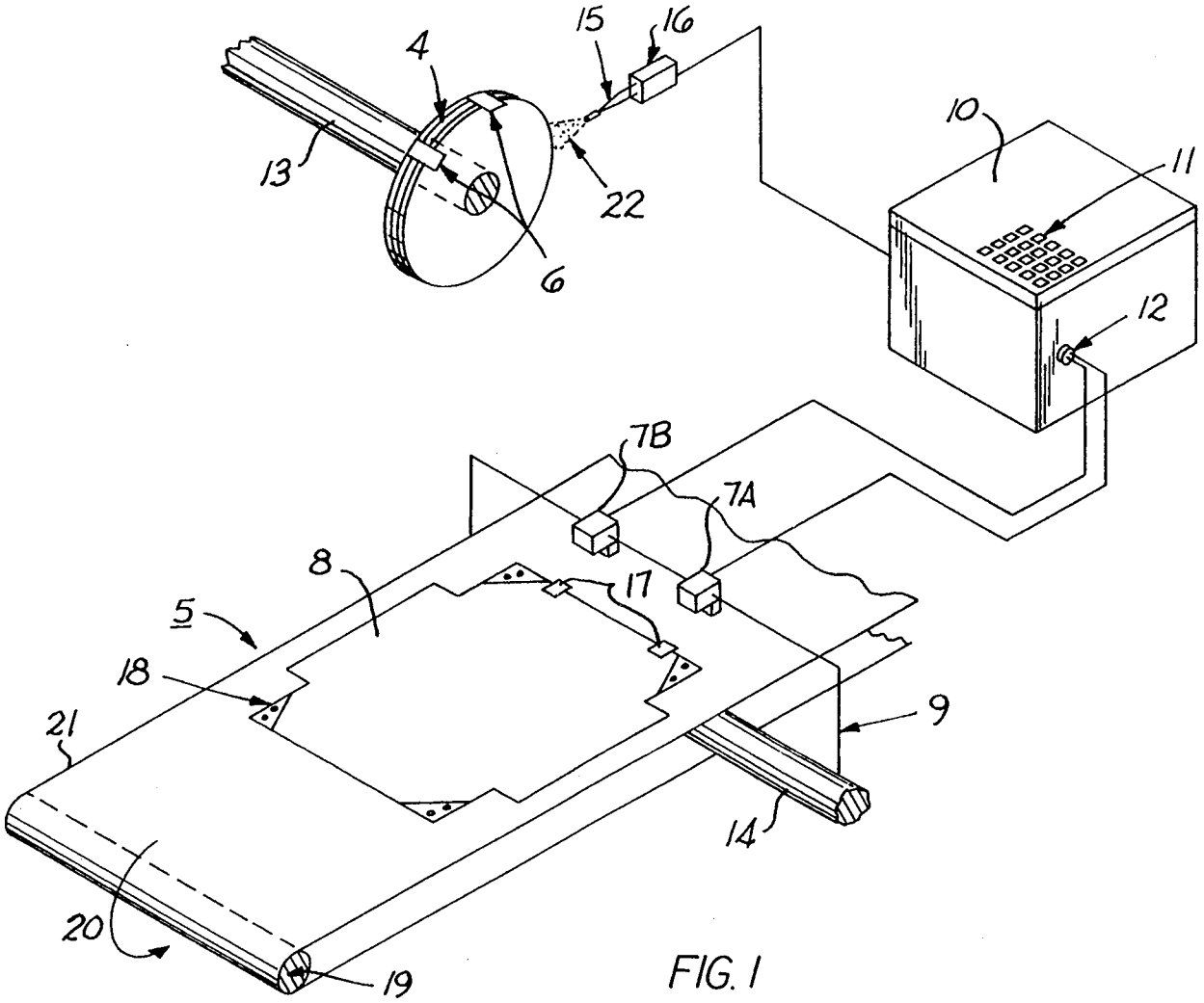
FIG. 1 is a fragmental system, partially in block diagram sketch in perspective of a variably programmable system for dispensing glue in accordance with this invention showing the relationship of a retrofitting system to a conveyor system of a gluing machine.

The embodiment of FIG. 1 provides a rotary marker wheel 4 synchronizing attachment coupled to the gluing machine conveyor system 5 for rotatably presenting the markers 6 attachable to the wheel 4 in positions for timing glue deposits along the travel path of the workpiece 8. The solenoid operated glue dispensor nozzles 7A, 7B are mounted on support rack 9 for laterally positioning across the width of the workpiece 8. Thus the electronic switching control system 10 by way of keyboard 11 together with the markers 6 positioned for rotation with the wheel 4 are programmable for depositing glue patterns universally over the worksheet 8, which typically is the blank for forming a carton. One or more nozzles, typically four, are connected to the switching control system 10 by means of an electrical connector 12. The keyboard typically has manually operated push to latch and push to release switches so that the electronic switching system is simplified, and programming is immediately visible from the switch array itself.

The shaft 13 for rotating the marker wheel 4, preferably rotates once for each cyclic presentation of a workpiece 8 at the illustrated gluing station. Thus the markers 6 subtend an angle that represents the length of a glue deposit along the direction of travel (20) of the workpiece along the conveyor belt 21. These markers 6 may be thin wires for depositing short dots of glue, or wider strips for depositing lines of glue of predetermined lengths. For the two shown markers 6, two different glue strips are programmed along the length of the worksheet 8. The wheel 4 is shown laminated, so that actually it constitutes, for example, four side by side wheels that can control independently four glue dispensing nozzles disposed across the width of the worksheet 8.

The keyboard 11 has twenty keys. Four are for programming the activation of four different heads independently. Each head additionally has four pattern control keys for programming or activating the respective glue nozzles for four different glue patterns along the length of the worksheet. The lengths are determined by the widths of a respective set of four markers 6. Thus, a simple control system gives the flexibility or universality of programming sixteen different glue stripes (or dots) anywhere on the surface of worksheet 8. The geometrical relationship is easily understood without knowledge of computer programming techniques, so that setup for a completely different gluing pattern is easily achieved in no more than ten minutes from a given set of markers 6 selected from a resident store that can be affixed to the wheels 4 by a simple mechanical clamping arrangement readily made by those skilled in the art.

The wheel 4, control system 10, nozzles 7 and rack 9 may be retrofit on any suitable conveyor system, such as typified by 5. The wheel 4 may contain a gearbox (not shown), if needed, to attach rotatable shaft 13 to a suitable available shaft 14 in the conveyor system 5. Preferably the wheel 4 and photosensor fiber 15 are enclosed after the markers are in place to avoid lint and dust from the operational environment of most carton factories.

Very precise timing is achievable from the synchronous relationship of the marker wheel 4 to the presentation of the worksheet 8 at the gluing station by the pusher brackets 17 in exact timing with the conveying system travelling towards the left as indicated by arrow 20.

Also to make the timing precise and to give the ability to glue very close to edges of fast moving worksheets 8, it is preferable to make the markers reflective and to sense with an optical detector 16. In this respect a small diameter optical fiber coupler link 15 over the gap 22 produces a very sharp leading edge response as the markers 6 are detected.

Accordingly thin wire markers 6 can be sensed to form glue dots in programmed positions such as the four corners 18 of the worksheet 8. In the exemplary pattern shown, two nozzles 7A, 7B may each be programmed to dispense a set of dots at the beginning and trailing edges of the worksheet. No corresponding precise control could be gotten from sensing the workpiece directly with an optical or electrical switch sensor as it passes the gluing station.

Figure 2:
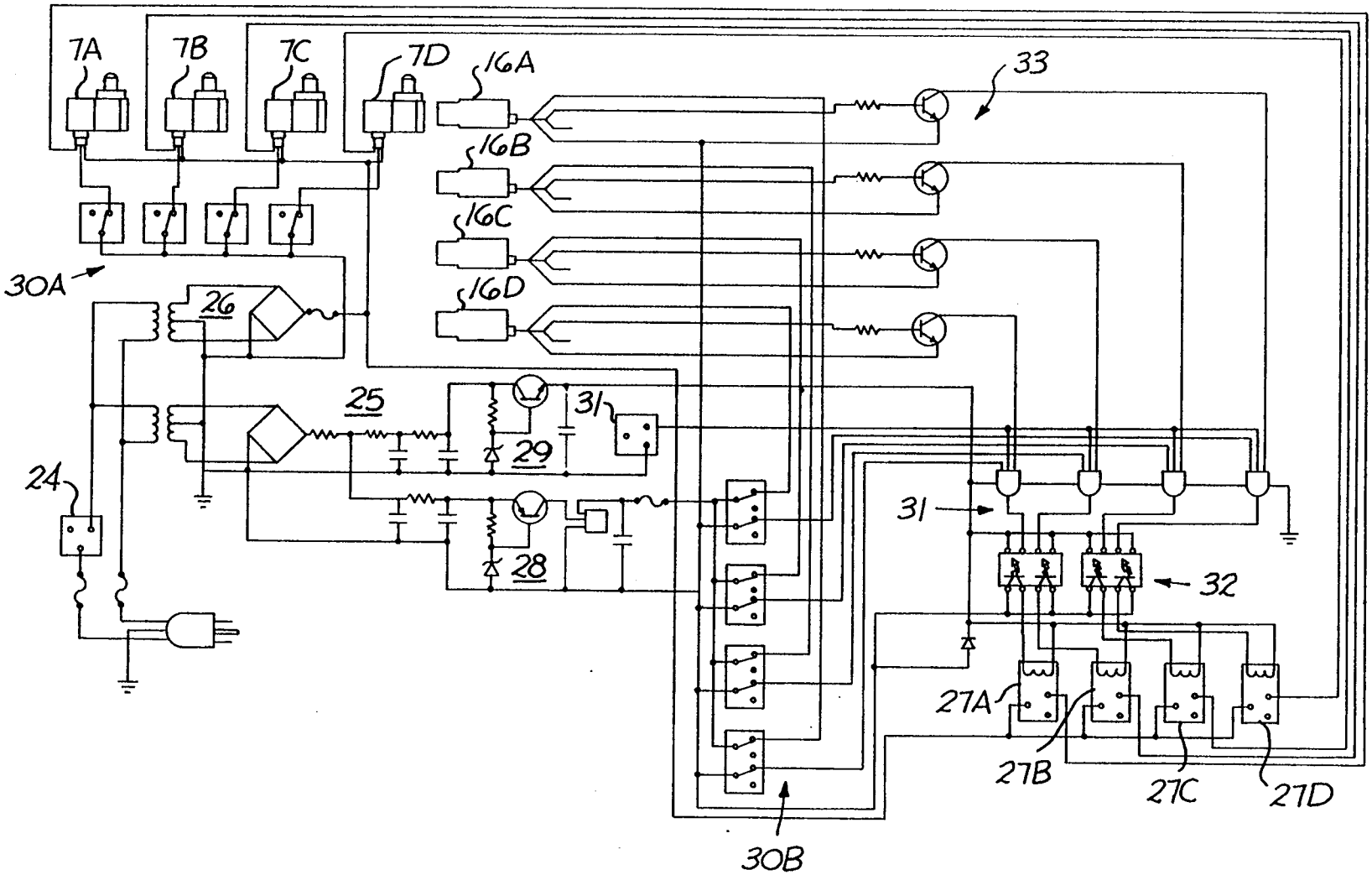
FIG. 2 is an electronic schematic circuit diagram of a universally programmable system embodiment of the invention for dispensing glue.

Now the electrical circuit embodiment of FIG. 2 will be addressed. The power to the system is controlled by off-on master switch 24 and the power supply circuit 25. The portion 29 supplies 5.5 volts for operation of logic circuit chips. The portion 28 supplies a highly filtered 11.5 volt for the optical sensors. The portion 26 supplies 24 volts for operation of the solenoid actuated glue nozzles 7. Separate ground connections are shown schematically.

The four program switches 30A, 30B serve to select the operating nozzles to be independently activated. The four respective nozzles are selected by contact bank 30A. The photosensing and logic for the respective nozzles are selected by contact bank 30B. The optical sensors 16 and amplifiers 33 by way of AND gates 31 control by the contacts of the solid state relays 27A–27D by medium of the intermediate isolater-amplifiers 32.

Thus, as programmed in response to the position of the markers on the four wheel sections heretofore discussed the relays 27 fire the nozzles 7 to deposit glue in a predetermined pattern. The markers are sensed by appropriate optical sensors 16 preferably provided with sensitivity controls adjustable under conditions of varying ambient light. The ganged program switch sections 30B thus activate the optical sensors and AND circuits 31 provided that the logic element power supply switch 31 is closed.

Figure 3:
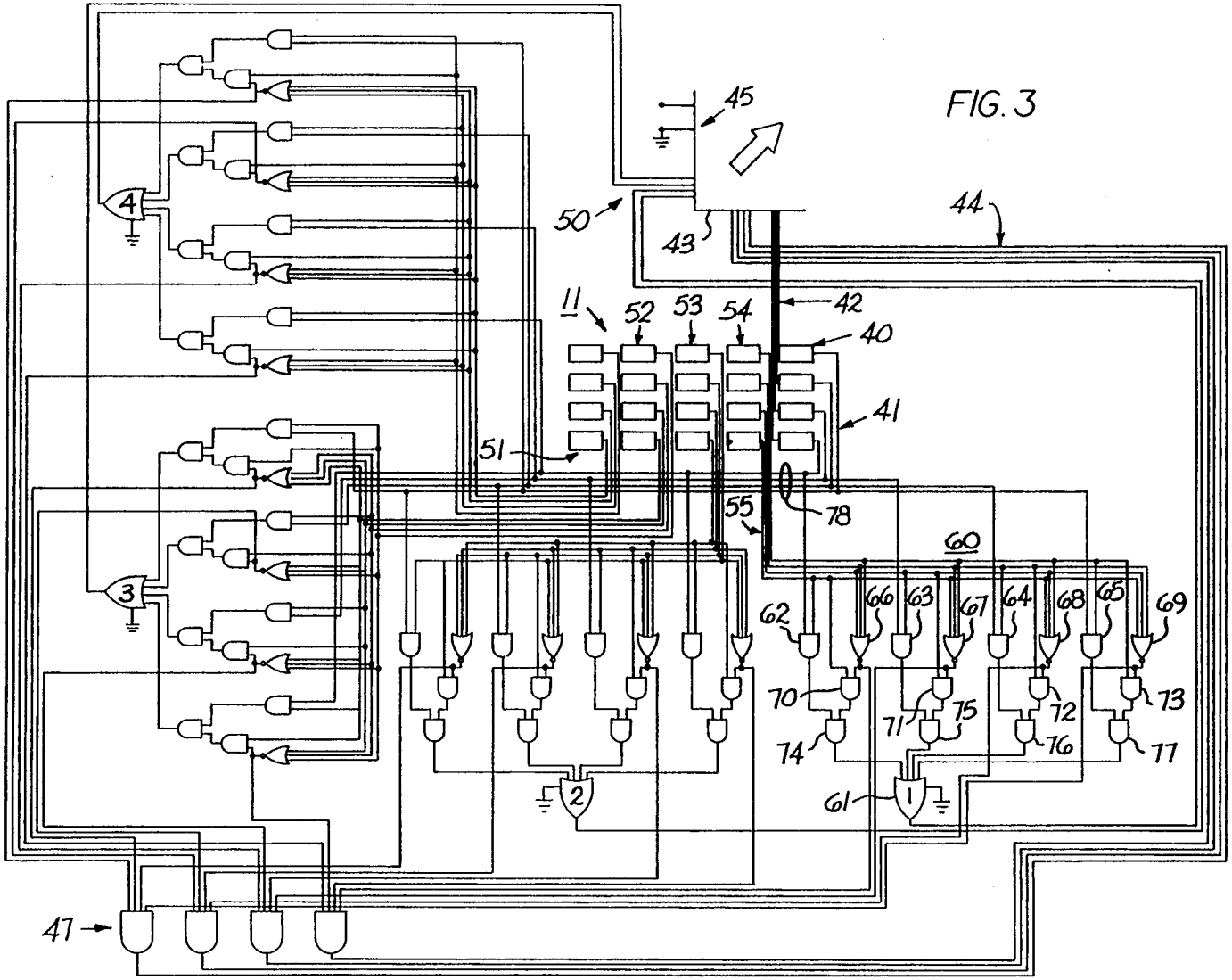
FIG. 3 is a schematic logic diagram embodiment for the control of a glue dispenser system embodying four solenoid operated glue guns from a twenty key keyboard.

Logic control circuits are shown in more detail in the embodiment of FIG. 3 for providing selection of four separate markers selectively presented. They may be side by side on different tracks about the marker wheel, or lined in sequence about the wheel to identify work positions and glue patterns along the length of a worksheet as it passes the gluing station. This is all controlled from a twenty key keyboard such as shown at 11 in FIG. 1, thereby to schedule selectively one or more of sixteen different glue locations on a workpiece from a set of four glue dispensing nozzles.

The AND gates are the 7432 type, the OR gates the 7408 type and the NOR gates the 7410 type, all readily commercially available. The ground connections and supply voltages are shown only for the solid state switches (1,2,3,4) as referenced to the power supply shown in FIG. 1. All function with negative logic. The solid state switches (NOR gates) are for example modules P8452 DM7410N available from Radio Shack.

The line of keyswitches 40 have input and output leads 41, 42. These constitute nozzle selection and activation switches corresponding in function to the switch banks 30 in FIG. 2. Output cable 42 at connector panel 43 connects to the power terminals of the individual actuating solenoids of the respective four nozzles. The four logic system output leads 44 the power drivers 47 connect to the ground side of the nozzles. The logic voltage and ground terminals 45 are connected to the logic elements in a routine manner (not shown). The four leads 50 actuate the respective set of photo detectors that are sensing the markers on the respective rotatable marker wheels or marker wheel sections.

The respective switch banks 51, 52, 53, 54 respectively control the selection of four different levels of activation of the photo detectors, such as for selection of four different sectors of the marker wheel for establishing four different zones along the length of the travel path of the workpiece past the gluing station where the nozzles are disposed. Alternatively different glue patterns may be selected from different markers on side by side portions of the rotatable marker wheel to program different patterns for different carton blanks. This permits independent selection of four glue positions for each nozzle. Accordingly the keyboard assembly 11 permits selective programming of the nozzles for different carton blanks, for example, so that they follow marker directions for each of the respective sixteen keys that may be selected. These keys have only one output lead, for example the set of leads 55 for key bank 54.

Thus, the program keys serve to establish appropriate logic paths that will activate a particular set of sixteen markers for operating the glue nozzles. This logic is now discussed with respect to the banks of keys 54 and 40. The respective keys in general from top to bottom relate to four different glue nozzles.

With respect to key bank 54, logic section 60 serves at OR circuit 61 to actuate one of the four optical sensor channels via leads 50. The layer of AND circuits 62–65 assure that the respective keys of both banks 54 and 40 are actuated. The NOR circuits 66–69 assure that only one of the respective four keys of bank 54 is actuated at the next layer of AND circuits 70 to 73. Thus when one and only one of the keys in bank 54 is actuated along with the corresponding nozzle key in bank 40 then the OR circuit 61 by way of AND circuits 74–77 will actuate the optical system for reading the corresponding marker for bank 54 on the corresponding marking wheel or wheel division.

With respect to key bank 40, the cable 78 assures for each logic section 60, etc. that there must be a correspondence between a selected nozzle from 40 and a selected marker array rom 54 to activate the photo sensors for producing a gluing signal. The AND circuit level 47 assures that each marker reading is appropriately distributed for activation of the corresponding glue nozzle.

Accordingly is readily seen that a versatile and yet simple programmable glue dispensing system is afforded by the teachings of this invention, which can be incorporated as an integral part of a gluing machine or can be retrofit as an independently attachable accessory. The significant advantages of low cost and simplified programming are afforded in a system with long life and high reliability. This system may be adapted for various head and workpiece configurations by those skilled in the art, and is useful in analogous systems that require determination of one or more variable work locations on a workpiece to be located synchronously with the presentation of that workpiece at a work station by conveyors or similar movable mechanisms.

The following claims define with particularity those novel features setting forth the nature and spirit of the invention.

I claim:

1. A variably programmable system for dispensing glue lines in patterns on carton blanks being conveyed cyclically by a conveyor mechanism powered by a rotating shaft coupled to a power source to convey the sheets past a gluing station, comprising in combination: at least one remotely controllable glue dispensing nozzle, a structure for disposing the nozzle at a stationary position in a posture for depositing a line of glue upon sheets being conveyed by said mechanism, a shaft from said conveyor mechanism synchronously timed with the presentation of said sheets at said gluing station, a mechanism for coupling a marker conveying wheel to said shaft for rotating in synchronism with the cyclic conveyance of the sheets past the gluing station, at least one marker for positioning on said marker wheel to rotate therewith in synchronous timing with the presentation of said sheets at said gluing station, said marker being of dimensions to subtend predetermined angles of rotation of the marker wheel, marker positioning means for positioning said marker to subtend a predetermined angle at controllable positions about the marker wheel to identify corresponding predetermined lengths along the path of the conveyed sheets scheduled for receiving said line of glue from said nozzle, a sensing array for detecting the presence of the marker as it rotates with said marker wheel, and nozzle control means responsive to the sensing array for operating said nozzle to deposit lines of glue upon said sheets in a pattern determined by the dimensions of said marker and its position relative to the wheel.

2. The system of claim 1 wherein said sensing array further comprises a photo detector for sensing the presence of said marker and an input sensor for the photo detector comprising an optical fiber link of a diameter of less than one millimeter for positioning adjacent the marker being rotated by said wheel to determine the presence of the marker subtended angle.

3. The system of claim 2 wherein said marker comprises a narrow strip for actuating said nozzle to deposit a glue dot on said sheet at a position along the length of the sheet designated by said marker as it is conveyed past the glue station.

4. The system of claim 2 further comprising at least one thin line mark disposed axially on the marker wheel for forming a glue spot at a position on the carton indicated when the thin line marker passes the optical fiber link.

5. The system of claim 1 wherein a plurality of markers are positioned at different positions of the rotation of said wheel for controlling the length of a plurality of lines.

6. The system of claim 5 wherein a plurality of control switches is provided for independently activating each one of the plurality of marker positions relative to the wheel so that the lengths of the lines are independently designated.

7. The system of claim 1 further comprising a plurality of markers disposed on said wheel in a plurality of independent tracks, a corresponding plurality of nozzles, and structure for disposing the nozzles variable across the width of sheets being conveyed past the gluing station.

8. The system of claim 7 wherein said nozzle control means further comprises a switching array controllable from a keyboard for selectively activating each of the plurality of independent tracks and corresponding nozzles.

* * * * *